United States Patent [19]

Hasegawa et al.

[11] 4,302,201

[45] Nov. 24, 1981

[54] METHOD FOR DEVELOPING ELECTRICAL LATENT IMAGES

[75] Inventors: Tetsuo Hasegawa; Katsumi Nagamatsu, both of Tokyo; Yoshihiro Nishikawa, Yokohama, all of Japan

[73] Assignee: Canon Kabushiki Kaisha, Tokyo, Japan

[21] Appl. No.: 38,841

[22] Filed: May 14, 1979

Related U.S. Application Data

[63] Continuation of Ser. No. 802,002, May 31, 1977, abandoned.

[30] Foreign Application Priority Data

| | | | |
|---|---|---|---|
| Jun. 2, 1976 | [JP] | Japan | 51-64389 |
| Jun. 8, 1976 | [JP] | Japan | 51-66923 |
| Jul. 9, 1976 | [JP] | Japan | 51-81534 |
| Aug. 16, 1976 | [JP] | Japan | 51-97583 |

[51] Int. Cl.[3] ..... D06P 5/20

[52] U.S. Cl. ..... 8/444; 8/469; 8/467; 430/106; 430/107; 430/120

[58] Field of Search ..... 8/444; 430/120, 106, 430/107

[56] References Cited

U.S. PATENT DOCUMENTS

| | | | |
|---|---|---|---|
| 3,236,776 | 2/1966 | Tomaneck | 252/62.1 P |
| 3,391,014 | 7/1968 | Fauser | 252/62.1 L |
| 3,454,347 | 7/1969 | Leimbacher | 8/2 |
| 3,890,240 | 6/1975 | Hochberg | 252/62.1 L |
| 3,966,396 | 6/1976 | Howes | 8/2.5 A |
| 3,991,226 | 11/1976 | Kosel | 252/62.1 L |
| 4,032,463 | 6/1977 | Kawanishi | 252/62.1 L |
| 4,070,186 | 1/1978 | Gibson et al. | 96/1 SD |
| 4,077,804 | 3/1978 | Vanzo | 96/1 SD |
| 4,078,931 | 3/1978 | Gibson et al. | 96/1 SD |

FOREIGN PATENT DOCUMENTS

| | | | |
|---|---|---|---|
| 741226 | 8/1966 | Canada | 8/2 |
| 1302690 | 12/1970 | Fed. Rep. of Germany | 252/62.1 P |
| 397710 | 6/1958 | Japan | 8/2 |
| 4717877 | 11/1966 | Japan | 96/1 SD |
| 944394 | 12/1963 | United Kingdom | 252/62.1 P |
| 999646 | 7/1965 | United Kingdom | 8/2 |

*Primary Examiner*—Maria Parrish Tungol

*Attorney, Agent, or Firm*—Fitzpatrick, Cella, Harper & Scinto

[57] ABSTRACT

A method for developing electrical latent images is disclosed in which electrically formed latent images are developed by using a mixture of at least two different toners having the same polarity. The two or more different kinds of toners in the mixture have a difference in triboelectric charge between them less that 10 μc/g. Furthermore, developing is carried out by using a liquid developer containing a mixture of at least two different toners having the same polarity. Each of the toners in the mixture should have a Zeta-potential more than 50 mV in absolute value and the difference in Zeta-potential between the different kinds of toners should be less than 50 mV.

16 Claims, 2 Drawing Figures

METHOD FOR DEVELOPING ELECTRICAL LATENT IMAGES

This is a continuation, of application Ser. No. 802,002, filed May 31, 1977, now abandoned.

BACKGROUND OF THE INVENTION a. Field of the Invention

The present invention relates to a method of developing electrically formed latent images and a developer adoptable for electrophotographic process, electrostatic paper printing process and electrostatic textile printing process for use in forming a multicolor image or a combination of many kinds of color images.

b. Description of the Prior Art

Hitherto, various types of photographic method and printing method have been known and used which comprise the steps of forming an electrical latent image (electrostatic latent image) and making the latent image visible with toner. For example, there are disclosed many electrophotographic methods of this type in U.S. Pat. No. 2,297,691, British Pat. No. 1,165,406 and British Pat. No. 1,165,405 specifications. In these electrophotographic methods, generally using a suitable photoconductive material, an electrical latent image is formed on a photosensitive member by means of various means and then the latent image is developed with toner. The toner image is, if necessary, transferred to a transfer sheet such as paper and fixed with heat, pressure or solvent steam to obtain a copy. To visualize such an electrical latent image with toner, various methods are also known. For example, U.S. Pat. No. 2,874,063 has disclosed the magnetic brush method, U.S. Pat. No. 2,618,552 has disclosed the cascade process and U.S. Pat. No. 2,221,776 has described the powder cloud method.

The methods hitherto proposed and known for producing a multicolor image by electrophotographic process, electrostatic printing process or the like typically comprise the steps of exposing an original utilizing a color filter to divide it into fundamental color components and developing each of the electrostatic latent image thus formed with toners colored in yellow, magenta and cyan or others respectively. By overlapping these developed color components, the neutral tints of the original are reproduced so that an aimed color image may be obtained. In this case, to reproduce all of the colors, only three kinds of toners differently colored as mentioned above or four kinds of toners added by black toner are required.

As other processes which involve the formation of multicolor image or many different colored images, there are known electrophotographic textile printing process and electrostatic textile printing process.

In these textile printing processes, an electrical latent image corresponding to the pattern of original is formed by a suitable method such as electrophotography and electrostatic printing. After developed with printing toner, the image is transferred onto a textile such as cloth and thereafter steaming, soaping and drying are carried out to it so as to pring the color pattern on it.

For such a textile printing according to the electrophotographic method, it is impossible to reproduce any color pattern in neutral tints by employing three or four colored toners as described above. If the above described process is employed to reproduce the multicolor image or the color pattern in neutral tint on a textile, forming of multicolor toner image or neutral color toner image may be possible, but fixing of the neutral color pattern by steaming will become entirely impossible on the textile.

For example, when a green pattern is desired to print on a textile and when a steaming is carried out for the transferred image which has been placed on the textile by transferring firstly a corresponding yellow toner image and secondly cyan toner image overlaid on the former, then it will be found that the color of the pattern really printed on the textile is not green but yellow that is the color of the firstly transferred toner image.

As will be understood from the above example, an ordinary color printing technique as previously mentioned can not be employed in effecting the electrophotographic textile printing process. If a green pattern is desired to print on a textile, a green toner must be used. However, for textile printing, there will be required a large number of different colors. Furthermore even in one color there are extensive varieties in gradation, saturation and the like. Therefore, it is very difficult to prepare and stock all the different color toners as required.

For electrostatic textile printing, another problem arises in printing blended yarn fabrics. Since some different sorts of yarns constitute the fabric and the kind of dyestuff suitable for the yarn is also different depending upon the sort of yarn, all kinds of dyestuffs suitable to all sorts of yarns present in the fabric have to be dispersed in the toners respectively. As there are many kinds of blended yarn fabric and a large number of colors used in printing them, it is again hardly performable to prepare and stock so many different kinds of toners. In addition, mixing and dispersing various dyestuffs into the toners often cause some changes of the toner in chargeability and polarity, which makes the toners useless. Between the electrophotographic textile printing process and the electrophotographic paper printing, there are several differences. This is because in the former some chemical dyeing is carried out after the developed image has been transferred to the textile. For example, for textile printing, the printing color toner must be chemically fixed on the textile and the printed color pattern should have a sharpness, color fastness to washing, color fastness to heat such as ironing and color fastness to light. Furthermore, to dye the textile with dyestuff(s) contained in the toner, the developed image transferred to the textile is subjected to steaming, soaping and drying treatments. After fixing, toner binder resin remained on the textile has to be removed by using some organic solvent. As these facts indicate, the electrophotographic printing process differs from the conventional electrophotographic process where the developed image is transferred to a paper and then fixed.

SUMMARY OF THE INVENTION

Accordingly, it is an object of the present invention to provide an improved method for developing electrical latent images and improved developer used therefor which allow to solve the difficult problems involved in the known electrophotographic process and electrophotographic textile printing process requiring a multicolor image or a combination of many different kinds of color images and which allow to reproduce a multicolor image or an image in neutral tint by preparing only several different kinds of toners in fundamental colors.

It is another object of the invention to provide an improved method for developing electrical latent images and an improved developer which allow to control the gradation and saturation of a color image at will.

A further object of the present invention is to provide an improved electrophotographic textile printing method by which a sharply and clearly printed pattern can be obtained.

An additional object of the invention is to provide an improved electrophotographic textile printing method by which a high density dyeing and a high speed dyeing are attainable.

According to one aspect of the present invention, there is provided a developing method which is characterized in that an electrical latent image is developed by using a mixed toner composed of at least two different toners having the same polarity and a triboelectric charge difference between the different kinds of toners less than 10 μc/g and preferably less than 7 μc/g.

According to another aspect of the invention, there is provided a developing method which is characterized in that an electrical latent image is developed by using a liquid developer containing a mixed toner composed of at least two different toners having the same polarity and a Zeta-potential difference between them less than 50 mV and preferably less than 30 mV.

The present invention also includes a developer used for carrying out the above described methods and an electrophotographic textile printing method utilizing the developing method.

Other and further objects, features and advantages of the invention will appear more fully from the following description.

DESCRIPTION OF THE PREFERRED EMBODIMENTS

Toners used in developing an electrical latent image are fine colored particles which are typically prepared by thoroughly kneading a mixture of natural or synthetic resin, various coloring matters such as pigment and dyestuff and if necessary other additives such as charge controlling agent, lubricant, dispersant etc. and milling the kneaded mixture into fine particles.

When two or more different kinds of toners which contain different resins and pigments or dyestuffs are mixed together and the mixed toner is used to develop an electrical latent image, then the toner, if it is used as a dry developer, usually causes a difficult problem regarding to its ability of adhesion to the electrical latent image. More particularly, one kind of toner in the mixed toner developer exhibits a different triboelectric charge for the toner carrier particle from that of the other. As a result, there occurs a difference in amount of toner adhered to the electrical latent image according to the difference of kind between the component toners existing in the mixed toner developer. There may occur even the case where one component toner is scattered off in the developing device. For these reasons, it was a common knowledge in the art that the use of a mixed toner developer was practically impossible.

Also, in the case of a liquid developer, the use of a mixed toner causes a similar trouble due to the difference in Zeta-potential between the different component toners. In addition to the problem of the difference in amount of toner adhered to the latent image, there occur the troubles of aggregation and precipitation of toner in the developer liquid. Therefore, the use of a mixed toner has been considered to be practically impossible and has not been tried until now.

However, by a vast inventive effort and a large number of experiments made by the inventors of this application, it has been found that the above described problem involved in the use of a mixed toner can be eliminated or becomes negligibly small when the difference in triboelectric charge in absolute value between the different kinds of the component toners in a mixed toner for dry developer is less than 10 μc/g, preferably less than 7 μc/g.

For a liquid developer, it has been also found that when the difference in Zeta-potential in absolute value between the different component toners in case each of them is independently formulated into a liquid developer is less than 50 mV, preferably less than 30 mV, a liquid developer containing a mixed toner can be advantageously used to develop an electrical latent image.

Figure 1:
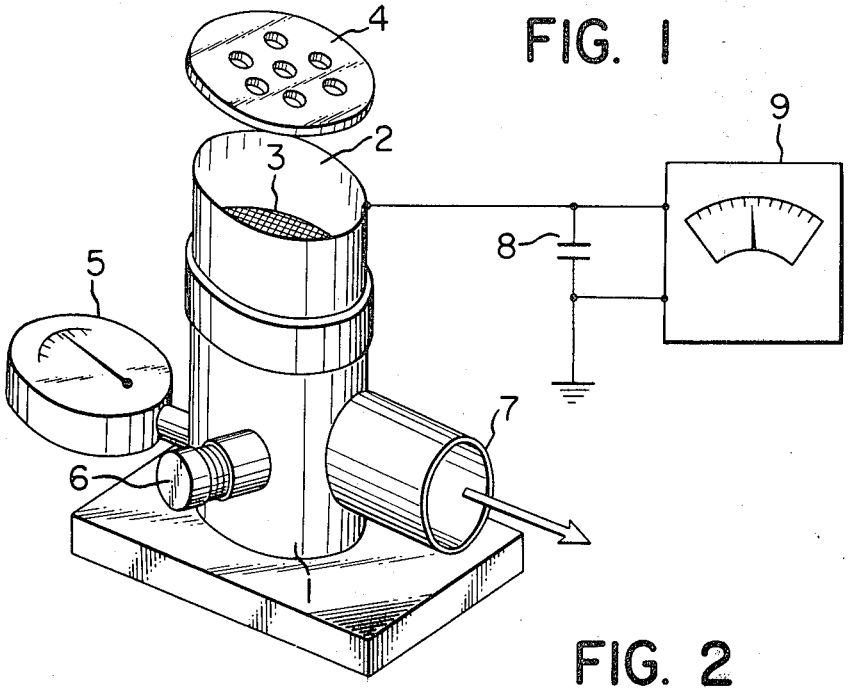
FIG. 1 is an explanative view of an apparatus used for measuring the triboelectric charge of toner.

Before entering the preferred embodiments, an explanation of the measuring method of triboelectric charge will be made referring to FIG. 1.

The measuring apparatus illustrated in the drawing comprises a metallic measuring vessel 2 provided with a 400 mesh screen 3 at the bottom. A mixture (developer) is prepared by mixing a toner the triboelectric charge of which is to be measured and a carrier (200 to 300 mesh) in the mixing ratio of 1:9 by weight. About 4 g of the mixture is taken into the vessel 2 and closed with a metallic cover plate 4. At this time, the total weight of the measuring vessel 2 is measured. The found value is set forth by W1(g). Then, a suction device 1 (at least its contacting portion with the vessel 2 is composed of insulating material) is actuated and a suction from its suction opening 7 is effected while adjusting the pressure of the vacuum meter 5 to 70 mm Hg by an air-flow regulator 6. Under this condition, one continues suctioning for a sufficient time (about one minute) and draws the toner off. At the time point, one reads the dial of voltage meter 9. The found value is set forth by V(volt). Reference numeral 8 designates a condenser the capacity of which is set forth by C (μF). Further, the total weight of the measuring vessel after the suction is measured and the found value is set forth by W2(g).

The following equation is used to calculate the triboelectric charge of the measured toner:

$$\text{Triboelectric charge of toner } (\mu c/g) = \frac{C \times V}{W1 - W2}$$

The measurement is to be carried out under the conditions of 23° C. and 50% RH.

The carrier used for measuring which may be, for example, iron powder or glass microsphere is of the size of 200–300 mesh. To obviate possible measuring error, the carrier should be thoroughly sucked by the above described suction device prior to mixing with the toner. The portion passing through the 400 mesh screen must be excluded.

Figure 2:
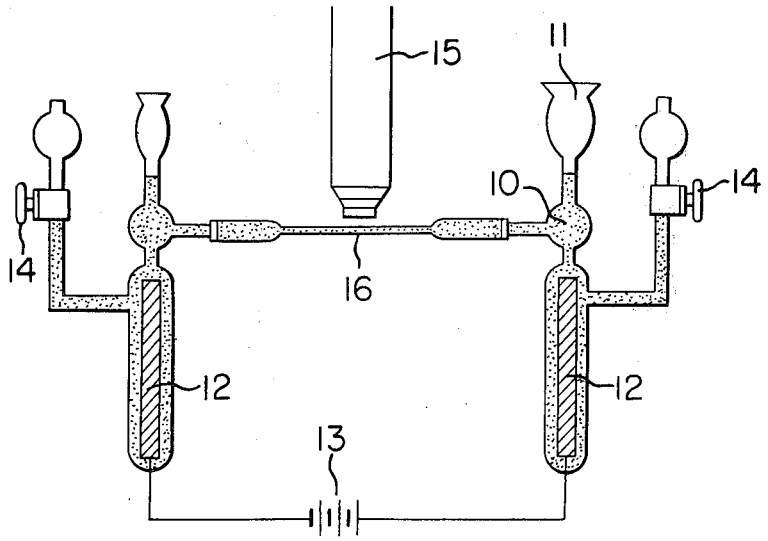
FIG. 2 illustrates one example of Zeta-potential measuring apparatus.

The measuring method of Zeta-potential of toner for a liquid developer will be explained referring to FIG. 2.

The apparatus illustrated in the drawing is made of glass. A liquid developer 10 contains in the dispersed state, a toner the Zeta-potential of which is to be measured. The liquid developer is introduced into the apparatus through a sample inlet 11. Reference numeral 12 designates electrodes connected with a DC source 13. Reference numeral 14 designates a sample liquid regulating cock. When the DC source is turned on after charging with the sample liquid (developer liquid), the toner starts moving in the direction of one of the two electrodes which is determined by the polarity of the toner. The moving speed $\mu$(m/sec.) of the toner passing through a flat tube 16 of 1 mm thickness is measured by a microscope 15. The measurement is carried out at room temperature and the temperature of the sample is 20° C.

The Zeta-potential of the toner is given by the following equation:

$$\text{Zeta-potential } (V) = \frac{4\% \cdot \eta \cdot \mu}{\epsilon \cdot \epsilon}$$

wherein, $\eta$: viscosity of carrier liquid (Kg/m.sec.)

$\epsilon$: dielectric constant of carrier liquid (F/m)

E: DC applied voltage (V/m)

$\pi$: 3.14

$\mu$: moving speed of toner (m/sec.)

The toner used in the invention for a dry developer has a particle size in the range of 1–100$\mu$ and preferably 5–50$\mu$. Before mixing, each of the component toners has a triboelectric charge more than 4 $\mu$c/g in absolute value and preferably more than 7 $\mu$c/g. Further, it is preferable to have the smallest possible difference in average particle size between the different kinds of the component toners to be mixed together. The difference in the range of 0–50$\mu$ is more preferable.

In the case of a liquid developer, the particle size of the toner is generally in the range of about 0.1–10$\mu$. When different kinds of toners are mixed, they preferably have a similar particle size distribution to each other. The difference in average particle size between them is preferably in the range of 0–5$\mu$, in particular 0–3$\mu$.

A good result can be obtained by using those toners which exhibit a Zeta-potential over 50 mV and preferably over 80 mV when each alone of the toners is formulated into a liquid developer.

As a binder resin for toners used in the present invention, any known natural or synthetic binder resin may be utilized. For example, polyester resin, silicone resin, polyethylene, polystyrene, epoxy resin, acrylic resin, methacrylic resin, polyamide resin, xylene resin, phenolic resin, cumarone indene resin, ethyl cellulose, rosin, shellac and copal may be used alone or in the form of their mixture. Also, any charge controlling agent, dispersant and the like known and used in conventional dry developers or liquid developers may be utilized in the present invention.

As a carrier for the developer according to the invention, also any known carrier may be used. For dry developer, glass microsphere, iron powder and fur are suitable. They may be used according to the cascade method, magnetic brush method and fur-brush method, respectively. For a liquid developer, also all of the known carriers may be used. Organic solvents having a volume resistance more than $10^9$ $\Omega$.cm and a dielectric constant less than 3 are preferable examples thereof. More particular examples are paraffin hydrocarbon, iso-paraffin hydrocarbon, alicyclic hydrocarbon and hydrocarbon halogenide.

While all the known pigments and dyestuffs may be used as a coloring agent for the toner of the invention, in the case of toners used in an electrophotographic textile printing process, a dyestuff suitable for the kind of textile to be printed is selected. For example, reactive dyes, direct dyes and sulphur dyes are suitable for cotton (cellulosic fibers) or silk, and acid dyes are suitable for polyamide fibers or wool. For acrylic fibers, cationic dyes and for polyester fibers, disperse dyes are suitably used, respectively.

According to the developing method of the invention, the neutral color of different toners mixed together can be faithfully reproduced. Thus, for example, by using a mixture of yellow toner and red toner, an orange color image is obtained and by using a mixture of red toner and blue toner, a purple color image is obtained. From these color images, the corresponding orange color print and purple color print can be obtained on a textile respectively by transferring and steaming. Furthermore, the gradation and saturation of the color image or color print can be controlled by combining fundamental color toners and other colors suitably selected from the group consisting of white toner, black toner and colorless toner.

When the textile printing is carried out to a blended yarn fabric, a toner suitable for one yarn in the fabric and another toner suitable for the other yarn are mixed taking into account the blending ratio and the printability of each of the yarns. The developed image obtained by developing the corresponding electrostatic latent image with the mixed toners is used to dye the blended yarn fabric. In this manner, the yarns in the fabric are equally dyed and fixed, and a good print image is produced. In this printing, the hue, saturation and gradation of color can be controlled at will by suitably mixing different color toners and white and black toners.

According to the developing method of the invention, any desired printing on various blended yarn fabric can be made also for a blended yarn fabric only by preparing several kinds of fundamental color toners necessary for single yarn fabric.

While roller transferring method and corona transferring method are generally employed to transfer a toner image to a textile, other known methods such as adhesion transferring, press-contact transferring and suction transferring also may be used. The toner image may be transferred directly to a textile or indirectly to a textile through an intermediate transfer member which temporarily receives the image.

The amount of toner to be transferred is generally in the range of 0.05–0.2 mg/cm$^2$ for the conventional electrophotographic process where the toner image is transferred to a paper. Also, for the conventional photograhic textile printing process, a similar range, namely the range of 0.1–0.3 mg/cm$^2$ has been used and many experiments have been carried out with the range until now.

The inventors of this application have made an intensive study and a vast experiment on the electrophotographic textile printing method, and thereby it has been found that there exists an optimum amount of toner transferred for textile printing which enables one to markedly improve the density of dyeing, speed up the textile printing and produce a good printed pattern with an excellent sharpness.

The optimum amount of toner transferred found by the inventors is in the range of 0.5–1.5 mg/cm$^2$ and preferably in the range of 0.7–1.2 mg/cm$^2$. When the toner is transferred with an amount in the above specified range, then a good result will be obtained. In other words, it has been found that a toner image portion transferred onto a textile with an amount of toner that is from two to seven times more than the amount hitherto used, can produce a sharp and clear image having a very higher density after steaming.

In general, the use of a larger amount more than 1.5 mg/cm$^2$ does not contribute to any further increase of effect and therefore it means a loss of toner. In addition, the use of a larger amount more than 1.5 mg/cm$^2$ will make it time-consuming to remove the binder resin by organic solvent after steaming.

On the contrary, the use of an amount of toner transferred more than 0.5 mg/cm$^2$ brings forth remarkable effect compared with the conventional electrophotographic textile printing method and essentially contributes to the production of a better printed pattern.

Examples of textile to which the present printing process is applicable include natural and synthetic fibers such as cotton, silk, wool, polyamide fiber, acrylic fiber and polyester fiber, and blended articles thereof.

For the steaming treatment which is carried out after a toner image has been transferred to a textile, high temperature steaming method, high pressure steaming method and dry heating method are generally employed. After steaming, the remaining resinous matter of the toner left on the textile is removed off by elution with an organic solvent. Methyl ethyl ketone, toluene, xylene, acetone, butyl acetate and trichlene have been found to be suitable solvents for this purpose.

Preferably the dyestuff is used in an amount of 1.25–30% (by weight) relative to the toner binder resin. In the present invention, it has been found that the range of 5–20% is particularly preferable. According to the results of experiments made by the inventors of this application, the use of dyes less than 1.25% can not bring forth any satisfactory result even when about 1.5 mg/cm$^2$ of toner is transferred to the textile. With further increased amounts of toner over 1.5 mg/cm$^2$, almost no effect on the density of dyeing has been found.

When over 30% of dyestuff is incorporated into the toner, then the toner will show unstable chargeability and it will cause fogging. However, there are some combinations of binder resin and dyestuff which allows one to use the dyestuff in an amount outside the range specified above.

The following examples are given to demonstrate the feature and effect of the invention.

"part" used in the example is part by weight in all the cases.

EXAMPLE 1

| | |
|---|---|
| Toner A: | |
| Polyester resin (KAO Soap Infg. Co., trade name ATLAC 382A) | 350 parts |
| Silicone resin (SHINETU Chemicals Co., trade name KR-220) | 50 parts |
| Disperse dye (MIKETON Polyester Brilliant Blue BG, C.I. Dispersed Blue 60) | 20 parts |
| Toner B: | |
| Polyester resin | 350 parts |
| Silicone resin | 50 parts |
| Disperse dye (MIKETON Polyester Yellow 5G, C.I. Dispersed Yellow 5) | 20 parts |

With the composition, blue toner and yellow toner were prepared respectively in the following manner:

At first, the resin and dye whre mixed with a Henschel mixer for about one minute and then kneaded with a roll mill for ten minutes at 160° C.

The mixture thus formed was granulated with a cutter mill into particles smaller than 2 mm and further pulverized with a supersonic jet powdering machine. Thus, toners having a particle size distribution between 5 and 25 were obtained.

Toner A and toner B prepared in this manner were measured by the previously described triboelectric charge measuring apparatus. The found values were −12.3 c/g for toner A and −15.2 c/g for toner B. The difference in triboelectric charge was 2.9 c/g.

Toner A and toner B were mixed together to make a mixed toner of 1:1 mixing ratio. Thereafter, 130 parts of the mixed toner and 1000 parts of carrier iron powder (Japan Iron Powder Co., Ltd; trade name EFV250/400) were mixed together as to produce a developer.

By using this developer, an electrostatic latent image with positive polarity was developed according to the magnetic brush method and then the developed image was transferred to a transfer paper sheet. A green copy was obtained. Also, the developed image was transferred to a sheet of polyester cloth and then it was subjected to a steaming treatment for 30 minutes at 130° C. A clear green print was obtained.

After copy running extending 1000 m in total, there was found no change in color.

The above procedure was repeated omitting only dyes from the toner B. A sky blue image was obtained.

Using various other resins and dyestuffs shown in the following table, a number of experiments were carried out in the same manner as that of Example 1. The results of these experiments are summarized in the following table as Examples 2–7 and a Comparative Example.

| Example No. | Resin (part) | Dye (part) | Triboelectric charge (μc/g) | Difference in triboelectric charge (μc/g) | Developing method | Color and change in color |
|---|---|---|---|---|---|---|
| 2 | Polystyrene (100) | SUMIKARON Yellow E-4GL (C.I. Disperse Yellow 51) (5) | −14.6 | | | green, |
| | | SUMIKARON Brilliant Blue-S-BL | | 7.4 | Fur brush | |
| | same | (C.I. Disperse Blue 143) (5) | − 7.2 | | | no change |
| 3 | Blend of epoxy resin and (50) | DIAMIRA-Yellow G (C.I. Reactive Yellow 14) (10) | +12.4 | | | green, |

-continued

| Example No. | Resin (part) | Dye (part) | Triboelectric charge (μc/g) | Difference in triboelectric charge (μc/g) | Developing method | Color and change in color |
|---|---|---|---|---|---|---|
| | xylene resin (50) | DIAMIRA-Blue 3R (C.I. Reactive Blue 28) (5) | + 9.5 | 2.9 | Cascade | no change |
| 4 | Polystyrene (100) | SUMIKARON Blue S-BG (C.I. Disperse Blue 73) (5) | +14.3 | | Magnetic brush | purple, |
| | same | KAYASET Red 026 (C.I. Disperse Red 59) (10) | + 5.0 | 9.3 | | no change |
| 5 | Polyester resin (100) | DIANIX Red FB-E (C.I. Disperse Red 60) (5) | −13.2 | | Magnetic brush | orange, |
| | same | DIANIX Yellow F3G-E (C.I. Disperse Yellow 64) (5) | −11.5 | 1.7 | | no change |
| 6 | Polyester resin (100) | SUMIFIX RED B (C.I. Reactive Red 22) (10) | −12.5 | | | purple, |
| | same | SUMIFIX Brilliant Blue-R (C.I. Reactive Blue 19) (5) | −12.3 | 0.2 | Cascade | no change |
| 7 | Polyester resin (100) | KAYASET Yellow 902 (C.I. Disperse Yellow 163) (5) | − 7.4 | | Magnetic brush | green, |
| | same | KAYASET Turquoise Blue 776 (C.I. Disperse Blue 60) (10) | − 7.2 | 0.2 | | no change |
| Comparative Example | Polystyrene (100) | KAYALON Polyester Light Flavin 4GL (C.I. Disperse Yellow 162) (5) | − 5.2 | | | green, |
| | same | KAYALON Polyester Blue-3R-SF (C.I. Disperse Blue 257) (5) | −19.8 | 14.6 | Magnetic brush | change (towards) blue |

NOTE:
In Examples 3 and 4, an electrostatic latent image with negative polarity was developed respectively.
In Examples 3 and 6, the developed image was transferred and printed to cotton respectively.
Change in color means change in hue observed after 1000 m copy running.

EXAMPLE 8

| | |
|---|---|
| Toner A: | |
| Polyester resin | 350 parts |
| Silicone resin (Solid Methyl Silicone Varnish) | 50 parts |
| Disperse dyes (MIKETON Polyester Brilliant Blue BG, C.I. Disperse Blue 60) | 20 parts |
| Toner B: | |
| Polyester resin | 350 parts |
| Silicone resin | 50 parts |
| Disperse dyes (MIKETON Polyester Yellow 5G, C.I. Disperse Yellow 5) | 20 parts |

With the composition, blue toner and yellow toner were prepared respectively in the following manner:

At first, the resin and dye were mixed with a Henschel mixer for about one minute and then kneaded with a roll mill for ten minutes at 160° C.

The mixture thus formed was granulated with a cutter mill into particles smaller than 2 mm and further pulverized with a supersonic jet powdering machine. Thus, toner having an average particle size of 3μ for toner A and toner having an average particle size of 2μ for toner B were produced.

Toner A and toner B prepared in this manner were dispersed into iso-paraffin hydrocarbon (trade name: Isober G) containing lecithin and their Zeta-potentials were measured by the previously described measuring apparatus. The found values were 84 mV for toner A and 93 mV for toner B. The difference in Zeta-potential was 9 mV.

Toner A and toner B were mixed together at the mixing ratio of 1:1 so as to make a mixed toner. 10 parts of the mixed toner and 30 parts of Isober G were thoroughly dispersed by using attritor. The dispersion was further dispersed into 1 liter of isopar G containing 20 mg of lecithin so that a liquid developer was prepared.

Using this liquid developer, an electrostatic latent image with positive polarity was developed and then the developed image was transferred to a polyester cloth. After steaming treatment (130° C., 30 min.), a clear and sharp green color print was obtained.

After copy running extending 1000 m in total, there was found no change in color.

The above procedure was repeated omitting only dye from the toner B, namely by using colorless toner B. Then, a sky blue image was obtained.

Also, the above procedure was repeated substituting a copolymer of alkyl benzene calcium sulfonate, stearly methacrylate and methacryl sodium sulfonate for the charge controlling agent. Thereby a similar result was obtained.

Using various other resins and dyestuffs shown in the following table, a number of experiments were carried out in the same manner as that in Example 8. The results obtained are summarized in the following table as Examles 9–14 and a Comparative Example.

| Example No. | Resin (part) | Dyes (part) | Average particle size of toner (μ) | Zeta-potential (V) | Difference in Zeta- (V) potential | Color and change in color |
|---|---|---|---|---|---|---|
| 9 | Polystyrene | SUMIKARON Yellow E-4GL (5) | 3.0 | 72 | 18 | Green, |
| | same | SUMIKARON Brilliant Blue-S-BL (5) | 2.5 | 90 | | No change |
| 10 | Blende of epoxy resin (50) and xylene resin (50) | DIAMIRA-Yellow-G (10) | 1.0 | 84 | 18 | Green, |
| | | DIAMIRA-Blue-3R (5) | 1.3 | 102 | | No change |
| 11 | Polystyrene | SUMIKARON Blue-S-BG (5) | 3 | 83 | 3 | Purple, |
| | same | KAYASET Red 026 (10) | 2.5 | 86 | | No change |
| 12 | Polystyrene resin (100) | DIANIX Red FB-E (5) | 1.6 | 84 | 28 | Orange, |
| | same | DIANIX Yellow F3G-E (5) | 1.8 | 112 | | No change |
| 13 | Polyester resin (100) | SUMIFIX Red B (10) | 2.1 | 100 | 7 | Purple, |
| | same | SUMIFIX Brilliant Blue-R (5) | 1.6 | 93 | | No change |
| 14 | Acrylic resin (100) | KAYASET Yellow 902 (5) | 2.1 | 80 | 5 | Green, |
| | same | KAYASET Turquoise Blue 776 (10) | 1.4 | 75 | | No change |
| Comparative Example | Polystyrene (100) | KAYALON Polyester Light Flavin 4GL (5) | 3 | 10 | 90 | Green, change (towards blue) |
| | | KAYALON Polyester Blue-3R-SF (5) | 1.3 | 100 | | |

NOTE:
In Examples 10 and 11, lecithin or manganese naphthenate was used as the charge controlling agent and an electrostatic latent image with negative polarity was developed.
In Examples 10 and 13, the developed image was transferred and printed to cotton.
Change in color means change in hue observed after 1000 m copy running.

EXAMPLE 15

| | |
|---|---|
| Toner A: | |
| Polyester resin | 350 parts |
| Silicone resin | 50 parts |
| Disperse dye (Nippon Kayaku Co., Ltd. trade name: KAYASET Turquoise Blue 776.) | 20 parts |
| Toner B: | |
| Polyester resin | 350 parts |
| Silicone resin | 50 parts |
| Direct (Nippon Kayaku Co., Ltd. trade name: KAYARUS Supra Blue-BRL200.) | 20 parts |

With the composition, blue toner A and blue toner B were prepared in the following manner:

At first, the resin and dye were mixed with a Henschel mixer for about one minute and then kneaded with a roll mill for ten minutes at 160° C.

The mixture thus formed was granulated with a cutter mill into particles smaller than 2 mm and further pulverized with a supersonic jet powdering machine. Thus toners having a particle size distribution between 5 and 25μ were obtained.

Toner A and toner B prepared in this manner were measured by the previously described triboelectric charge measuring apparatus. The found values were −12.3 μc/g for toner A and −14.6 μc/g for toner B. The difference in triboelectric charge was 2.3 μc/g.

Toner A and toner B were mixed together at the mixing together at the mixing ratio of 1:1 as to make a mixed toner. Thereafter 130 parts of the mixed toner and 1000 parts of carrier iron powder (Japan Iron Powder Co., Ltd., trade name: EFV250/400) were mixed together so as to produce a developer.

Using this developer, an electrostatic latent image with positive polarity was developed according to magnetic brush method and then the developed image was transferred to a polyestercotton blended cloth. After steaming treatment (130° C., 30 min.), a clear and sharp print colored in blue was obtained.

For the purpose of comparison, two batches of toner were prepared one of which contained toner A alone and the other contained toner B alone as its toner component. These two different developers were used to print the above mentioned blended cloth. It was found that only either one of the fibers in the cloth i.e. polyester fiber and cotton fiber was predominantly dyed in either case.

Furthermore, employing other disperse dyes (C.I. Disperse Yellow 5) in place of the above shown dye for toner A, a printing was carried out in the same manner onto the same blended cloth.

The polyester fiber was dyed in yellow whereas the cotton fiber was dyed in blue and as a whole a green print image was obtained.

EXAMPLE 16

| | |
|---|---|
| Toner A: | |
| Polyester resin | 350 parts |
| Silicone resin | 50 parts |
| Disperse dye (C.I. Disperse Blue 71) | 20 parts |
| Toner B: | |
| Polyester resin | 350 parts |
| Silicone resin | 50 parts |
| Direct dye (C.I. Direct Blue 270) | 20 parts |

With the above given composition, blue toner A and blue toner B were prepared in the following manner:

At first, the resin and dye were mixed with a Henschel mixer for about one minute and then kneaded with a roll mill for 10 minutes at 160° C.

The mixture thus formed was granulated with a cutter mill into particles smaller than 2 mm and further pulverized with a supersonic jet powdering machine. Thus, toner having an average particle size of 3μ for toner A and toner having an average particle size of 2μ for toner B were produced.

Toner A and toner B prepared in this manner were dispersed into iso-paraffin hydrocarbon (trade name: isopar G) containing lecithin and their Zeta-potentials were measured by the previously described measuring apparatus. The found values were 84 mV for toner A and 90 mV for toner B. The difference in Zeta-potential was 6 mV.

Toner A and toner B were mixed together at the mixing ratio of 1:1 so as to make a mixed toner. 10 parts of the mixed toner and 30 parts of Isober G were thoroughly dispersed by using attritor. The dispersion was further dispersed into 1 liter of isopar G containing 20 mg of lecithin so that a liquid developer was prepared.

Using this liquid developer, an electrostatic latent image with positive polarity was developed and then the developed image was transferred to a polyester-cotton blended cloth. After steaming treatment (130° C., 30 min.), a clear and sharp blue color print was obtained.

According to the procedure as described in Example 15 or Example 16, a number of similar experiments were carried out and similar good results were obtained. Resins, dyestuffs and blended fabrics used are summarized in the following table as Examples 17–20. ,

| Example | Resin | Dyes | Blended fabric |
|---|---|---|---|
| 17 | Styrene-butadiene copolymer | Disperse dye (for polyester) DIANIX Navy Blue SR.FS (C.I. Disperse Blue 30) | Polyester-(50) nylon (50) |
| | Styrene-butadiene copolymer | Acid dye (for nylon) DIACID DL Yellow 2GP (C.I. Acid Yellow 29) | |
| 18 | Polyamide resin | Direct dyes (for cotton) DIACOTTON First Orange WS (C.I. Direct Orange 29) | Cotton-(70) nylon (30) |
| | Polyamide resin | Acid dyes (for nylon) DIACID DL Blue BR (C.I. Acid Blue 41) | |
| 19 | Polystyrene | Reactive dye (for cotton) DIAMIRA Blue 3R (C.I. Reactive Blue 28) | Cotton-(65) polyester (35) |
| | Polystyrene | Disperse dye (for polyester) DIANIX Red FL-FS (C.I. Disperse Red 72) | |
| 20 | Polyester resin | Disperse dye (for polyester) DIANIX Brilliant Yellow 7G-SE (C.I. Disperse Yellow 100) | Polyester-(50) hemp (50) |
| | Polyester resin | Direct dye (for hemp) DIACOTTON Direct Blue 2BA (C.I. Direct Blue 270) | |

NOTE:

10 parts of dye were used to 100 parts of resin in each of the above Examples.

EXAMPLE 21

| | |
|---|---|
| Polyester resin | 350 parts |
| Solid silicone varnish | 50 parts |
| Disperse dye (MIKETON Polyester Brilliant Blue BG, C.I. Disperse Blue 60) | 30 parts |

With the above given composition, the resin and dye were mixed together and then kneaded with a roll mill for ten minutes at 160° C. The mixture was granulated first and then pulverized with a supersonic jet powdering machine. In this manner, a toner for textile printing was prepared. To make a developer, 130 parts of the toner were mixed with 1000 parts of carrier iron powder (the same as used in Example 1).

By using this developer, an electrostatic latent image with positive polarity was developed according to fur-brush method. At the time, the amount of toner was 1.5 mg/cm$^2$.

The toner image thus produced was transferred to a polyester textile (trade name: Teijin Tetron ®, TEIJIN Co. Ltd., polyester 100%) with the amount of 1.0–1.1 mg/cm$^2$ of toner transferred and then subjected to steaming treatment.

The toner binder washed off by washing for one minutes by using trichlene and further washing with a solution of soap was carried out. A blue print pattern having high density and excellent sharpness was obtained.

The above procedure was repeated variously changing the amount of toner transferred within the range of 0.5–1.5 mg/cm$^2$. In the cases where the amount was over 0.8 mg/cm$^2$, almost constant results were obtained. But, even the cases of the amount between 0.5 and 0.7 mg/cm$^2$, the print patterns obtained thereby showed very excellent sharpness and higher density compared with the case where some 0.3 mg/cm$^2$ of toner was transferred according to the prior art.

Also, the above procedure was repeated changing the amount of dye to 40 parts and 60 parts. Then similar results were obtained.

Further similar experiment was carried out using other dye, DIAMIRA Blue 3R (trade name, MITSUBISHI KASEI CO., LTD.) in place of the toner dye mentioned above. The developed toner image was transferred to cotton textile. A clear blue print pattern was obtained.

The following table shows other examples similar to Example 2.

| Ex. No. | Resin (part) | Dye (part) | Amount of toner transferred (mg/cm$^2$) | Textile |
|---|---|---|---|---|
| 22 | Polystyrene (100) | SUMIKARON Yellow E-4GL (8) | 1.0–1.1 | Polyester |
| 23 | Epoxy resin (50) Xylene resin (50) | DIACOTTON First Orange WS (C.I. Direct Orange 29) (15) | 0.8–0.9 | Cotton |
| 24 | Polyamide resin (100) | DIACID DL-Blue-BR (C.I. Acid Blue 41) (10) | 1.2–1.3 | Nylon |
| 25 | Styrene-butadiene copolymer | DIANIX Navy Blue SR.FS (C.I. Disperse Blue 30) (10) | 1.0–1.1 | Polyester |
| 26 | Polyester resin (100) | DIACOTTON Direct Blue 2BA (C.I. Direct Blue 270) | 1.0–1.1 | Cotton |

As to textile printing, it was also found relating to the previous Examples 1–20 that when the toner image was transferred to textile at the amount in the range of 0.5–1.5 mg/cm$^2$, preferable result was obtained in respective case. In particular, very preferable results were obtained by using the range of 0.7-1.2 mg/cm$^2$.

What we claim is:

1. A textile printing method comprising at least the steps of (i) mixing together at least two different component toners, each having the same polarity, and a dry carrier to obtain a dry developer and developing an electrical latent image with said dry developer; wherein the absolute value of the triboelectric charge of each component toner is more than 4 μc/g and the difference in triboelectric charge between each component toner is less than 10 μc/g; wherein each component toner comprises fine particles of 1–100 microns in size and is composed of a binder resin having a dye or pigment dispersed therein; and wherein the binder resin of each component toner is the same and wherein the dye or pigment of each component toner is different;

(ii) transferring an amount of the resulting developed toner image onto a textile to provide an amount of transferred toner on said textile in the range of 0.5–1.5 mg/cm$^2$ as the image portion, and (iii) dyeing the textile by using said transferring toner image.

2. A textile printing method as claimed in claim 1 wherein the particle size of each of said component toners is from 5–50 microns.

3. A textile printing method as claimed in claim 1 wherein the absolute value of the triboelectric charge of each of said component toners is more than 7 μc/g.

4. A textile printing method as claimed in claim 1 wherein the difference in average particle size between each component toner is in the range of 0–50 microns.

5. A textile printing method as claimed in claim 1 wherein said toner image is transferred onto the textile in an amount of from 0.7 to 1.2 mg/cm$^2$ as the image portion.

6. A textile printing method as claimed in claim 1 wherein the amount of dye or pigment in each of said component toners is from 1.25 to 30% by weight, based on the weight of the toner binder resin.

7. A textile printing method as claimed in claim 1 wherein the amount of dye or pigment in each of said component toners is from 5 to 20% by weight, based on the weight of the toner binder resin.

8. A textile printing method as claimed in claim 1 wherein said developed toner image is temporarily transferred to an intermediate transfer member and thereafter transferred onto the textile.

9. A textile printing method as claimed in claim 1 wherein the textile having said transferred toner image thereon is subjected to a steaming treatment and thereafter the resinous matter is removed.

10. A textile printing method as claimed in claim 1 wherein said different dyes or pigments contained in said different component toners are those which are suitable for dyeing different fibers constituting a blended yarn fabric.

11. A textile printing method comprising at least the steps of (i) developing an electrical latent image with a toner comprising a resin binder having dispersed therein from 1.25 to 30% by weight, based on the weight of said resin binder, of a dye and having a triboelectric charge, the absolute value of which is more than 4 μc/g;

(ii) transferring the resulting developed toner image onto a textile to provide an amount of transferred toner on said textile in the range of 0.5–1.5 mg/cm$^2$ as the image portion; and (iii) dyeing said textile by using said transferred toner image.

12. A textile printing method as claimed in claim 11 wherein said toner contains said dye in an amount of from 5 to 20% by weight, based on the weight of the binder resin.

13. A textile printing method as claimed in claim 11 wherein said toner is transferred onto said textile 17 on amount of 0.7–1.2 mg/cm$^2$ as the image portion.

14. A textile printing method as claimed in claim 11 wherein said developed toner image is temporarily transferred to an intermediate transfer member and thereafter transferred onto the textile.

15. A textile printing method as claimed in claim 11 wherein the textile having said transferred toner image thereon is subjected to a steaming treatment and thereafter the resinous matter is removed.

16. A textile printing method as claimed in claim 11 wherein said dye is selected from the group consisting of direct dyes, sulphur dyes, indanthrene dyes, naphthol dyes, reactive dyes, acid dyes, chromium dyes, 1:2 type complex dyes, 1:1 type complex dyes, disperse dyes, azoic dyes and cationic dyes.

* * * * *